United States Patent [19]

Pinnow et al.

[11] Patent Number: 4,576,425

[45] Date of Patent: Mar. 18, 1986

[54] FOOD SERVICE CART DOOR STRUCTURE

[75] Inventors: Curtis C. Pinnow, Libertyville; Brian Gill, Mundelein, both of Ill.

[73] Assignee: Carter-Hoffman Corporation, Mundelein, Ill.

[21] Appl. No.: 586,301

[22] Filed: Mar. 5, 1984

[51] Int. Cl.[4] ..... A47B 63/00

[52] U.S. Cl. ..... 312/324; 312/325

[58] Field of Search ..... 312/323, 250, 324, 325, 312/326; 16/366, 389; 292/DIG. 15

[56] References Cited

U.S. PATENT DOCUMENTS

| | | | |
|---|---|---|---|
| 723,478 | 3/1903 | Mills | 292/DIG. 15 |
| 1,936,319 | 11/1933 | Wingate | 16/366 |
| 3,148,915 | 9/1964 | Connolly | 312/324 |
| 3,321,258 | 5/1967 | MacKay | 312/324 |
| 4,294,498 | 10/1981 | Van Luit | 16/389 |

*Primary Examiner*—William E. Lyddane
*Assistant Examiner*—Joseph Falk
*Attorney, Agent, or Firm*—Wood, Dalton, Phillips, Mason & Rowe

[57] ABSTRACT

According to the invention, an improved hinge is provided for use with a food service cart of the pass through design. Opposite sides of the cart defining the access openings are sealed by pivoting doors which open towards each other and against a common endwall. One of the doors is hinged in conventional manner as by the use of pairs of cooperating, vertically spaced brackets and hinge pins. A pin is pivoted in a portion of each bracket extending beyond the common endwall so that the one door can be swung through a 270° range to seat flushly against the endwall. The invention contemplates the provision of a lengthened bracket associated with the door opposite the first door. The second door is pivoted about a point further from the plane of the endwall than the pivot on the first door. The second door can thus be folded in parallel, overlapping relationship with the first door whereas it would otherwise interfere with the corner at the free end of the first door.

6 Claims, 5 Drawing Figures

FOOD SERVICE CART DOOR STRUCTURE

BACKGROUND OF THE INVENTION

1. Field of the Invention

This invention relates to food service carts and, more particularly, to an improved door hinge structure for a pass through design.

2. Background Art

Stainless steel, insulated food service carts are commonly used by caterers in banquet settings. Among their numerous other uses, the carts are used for food delivery in hospital hallways.

One of the most versatile of cart constructions is the pass through design mobilized by a rolling carriage. Hinged doors are provided to gain access to the tray storage area from opposite sides of the cart. Within the cart, vertically space guide rails accept conventional food trays. The trays are slidingly admitted into and withdrawn from the storage area along the rails.

The pass through design is advantageous from the standpoint of loading and is particularly adaptable to the hospital environment, where in the trays can be removed to simultaneously service rooms on both sides of a hallway.

Heretofore, the pass through design has had one glaring drawback. When only one door is provided on each side of the cart, the doors are normally hinged at diagonally situated corners. A single door that permits access to the entire inner area of the cart is obtrusive and impractical in close quarters where the carts are most often used. Further, the doors, when fully open, protrude lengthwise beyond the ends of the cart or, when folded against the endwall, protrude beyond the opposite sidewall. In either event the doors take up substantial amounts of space.

Accordingly, two doors are often used in the open walls of the cart and are opened away from each other. While this solves the problem of an unmanageable door size, the doors on opposite sides interfere with each other and cannot be situated flushly against the end walls of the cabinet. Typically, a door on one side may be seated flushly against the endwall and the corresponding door on the opposite side pivoted against the one door. The one door encounters and limits the range of pivoting of the opposite door which juts out angularly in relationship to the endwall.

This has presented a serious problem to large volume food purveyors. As many as twenty five of the carts may be aligned closely adjacent each other in a food preparation area. The doors on adjacent carts interfere with each other and prevent close end-to-end alignment. This is particularly critical in food preparation areas where space is at a premium.

The present invention is specifically directed to overcoming one or more of the above enumerated deficiencies known in the art.

SUMMARY OF THE INVENTION

According to the invention, an improved hinge is provided for use with food service carts of the pass through design. Opposite sides of the cart defining the access openings are sealed by at least one hinged door. The doors on opposite sides fold toward each other and a common endwall. One of the doors is hinged in conventional manner as by pairs of brackets and hinge pins at vertically spaced locations. Each of the pins on the one door engages a bracket portion extending beyond the common endwall so that the one door can be pivoted through a 270° range to seat flushly against the endwall.

The invention contemplates the provision of a lengthened bracket associated with the door opposite the conventionally hinged door. The opposite door is pivoted about the brackets at a point further from the endwall than the hinge on the first door. The second door can thus be folded parallel to the open first door whereas it would otherwise interfere with the corner at the free end of the first door and remain skewed to the endwall.

The principal objective of the invention is to minimize the endwise extension of the cart with opposite side doors in an open position. Preferably, the extension of the second bracket is chosen so that with the second door pivoted into parallel relationship with the face of the common endwall, the second door is spaced from the endwall by a distance approximately equal to the thickness of the first door. Consequently, the open first door facially engages the common endwall and the open second door in turn facially engages the first door to minimize the dimensions of the cart during loading or unloading.

A further object of the invention is to provide a latch to maintain the overlapping doors in their open positions. The latch prevents inadvertent swinging of the doors, particularly while transporting the cart.

Other objects and advantages of the present invention will become apparent upon reviewing the following detailed description, including the claims and appended drawings.

DETAILED DESCRIPTION OF THE DRAWINGS

Figure 2:
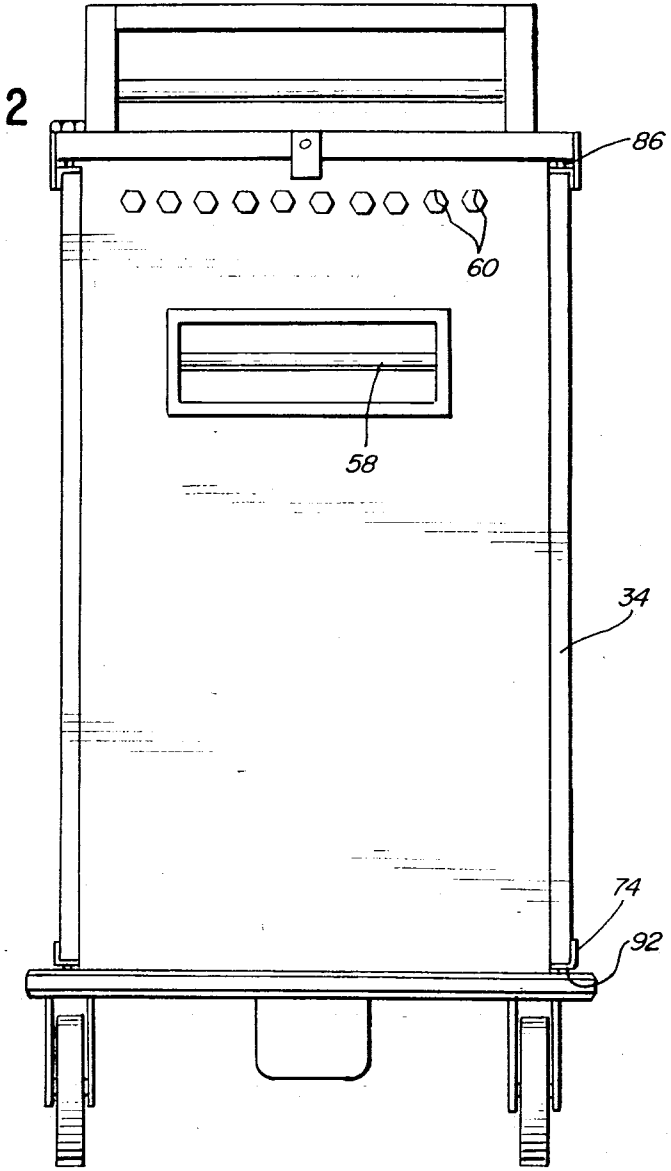
FIG. 2 is an end elevation view of the food service cart in FIG. 1.
Figure 1:
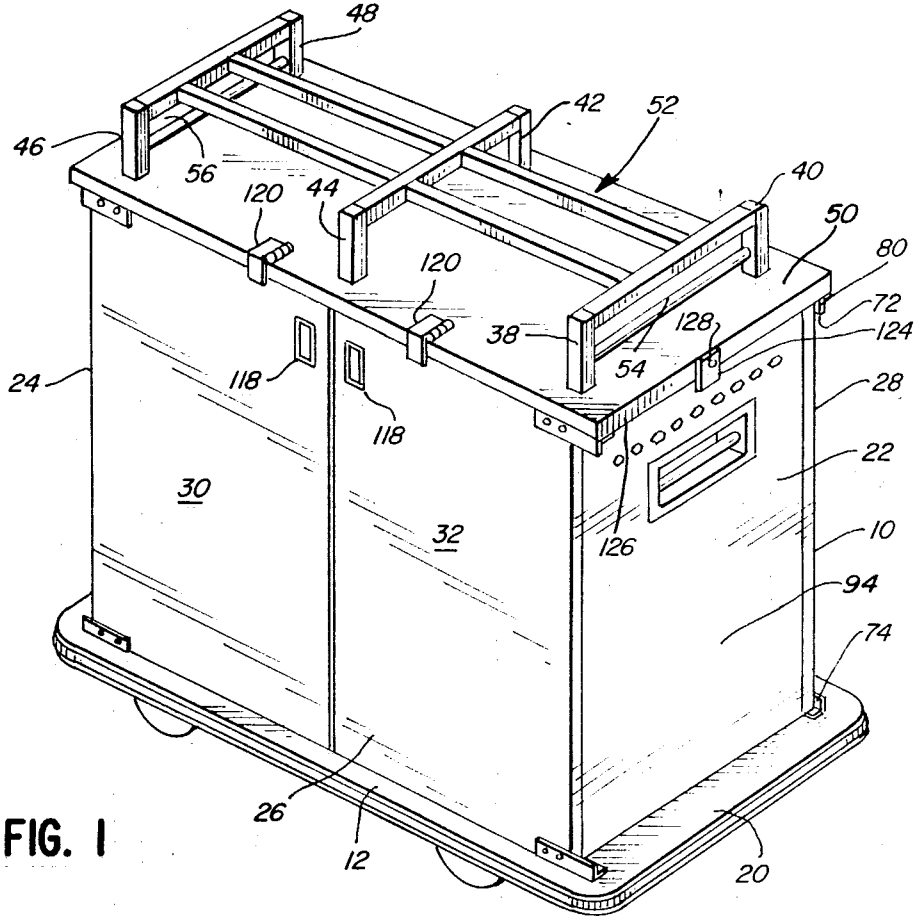
FIG. 1 is a perspective view of a food service cart incorporation a preferred form of door hinge according to the present invention.

A food service cart of the pass through design, to which the present invention is adaptable, is depicted in FIGS. 1–5. A rectangular tray storage cabinet 10 on the order of six feet in height is mounted on a wheeled undercarriage 12 with a fixed caster pair 14 at one end of the undercarriage and swiveling caster pair 16 at the other.

The cabinet 10 is substantially rectangular in configuration and peripherally defined by endwalls 22, 24 and sidewalls 26, 28. The sidewall 26 is substantially open and sealed by cooperating hinged doors 30, 32, with opposite sidewall 28 sealed in similar fashion by doors 34, 36. The tray storage cabinet 10, and a bearing platform 20 in association with the undercarriage 12 are preferably made from sheet stainless steel. The doors are a double panel construction with encased sound insulation fiberglass. A rubber bumper 18 peripherally surrounds the platform to prevent damage to the cabinet during transportation.

The cabinet is framed by tubular, stainless steel stock. Six upright frame members 38 through 48 protrude through the top plate 50 of the cabinet and provide a firm foundation for a support structure shown at 52 for suspension and transportation by a conventional conveyor system.

Spanning between uprights 38, 40 and 46, 48 are tubular push bars 54, 56, respectively which assist handling of the cabinet. Recessed push handle 58 is provided in endwall 22 for propelling and steering the cart. A series of apertures 60 are provided in the endwall 22 adjacent the upper region thereof to vent the inside of the cabinet.

Within the cabinet, a plurality of L-shaped tray guides 62 are mounted in vertically spaced relationship. The tray guides 62 have open ends to provide an unobstructed tray path through either sidewall of the cabinet. Three tray storage columns 63 are provided in the disclosed embodiment, with spacers 64 (one shown) dividing the columnar area equally between the endwalls.

Figure 4:
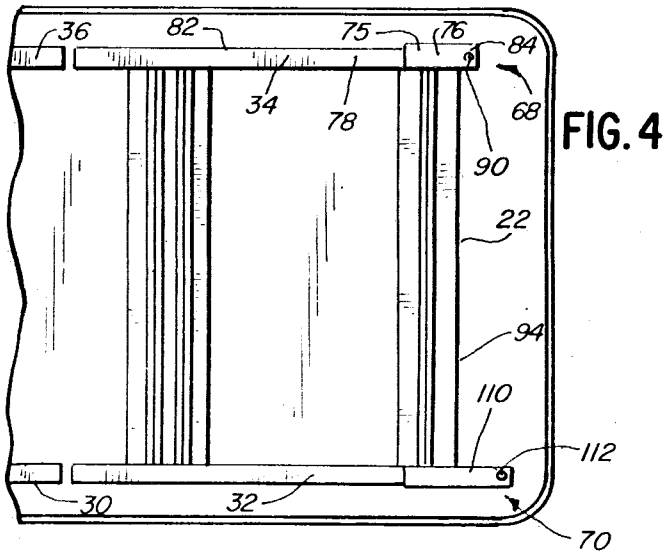
FIG. 4 is a sectional view of the door hinge structure along line 4—4 of FIG. 3 with the doors in a closed position.
Figure 5:
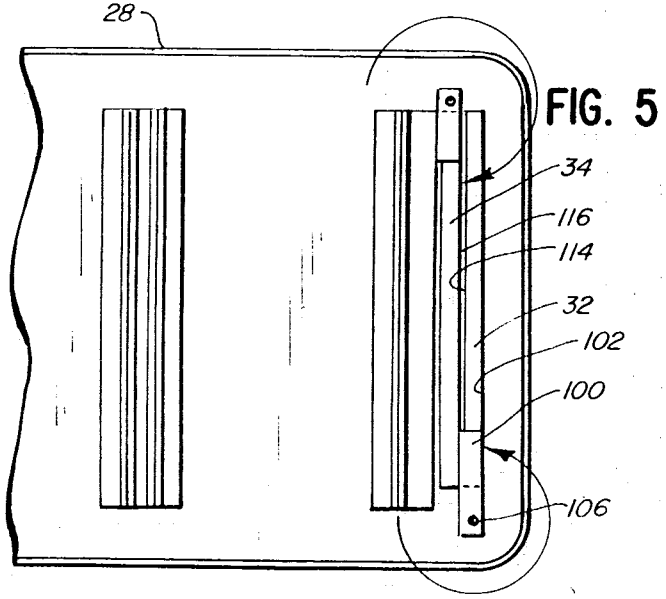
FIG. 5 is a view similar to that in FIG. 4 with the doors in an open position.
Figure 3:
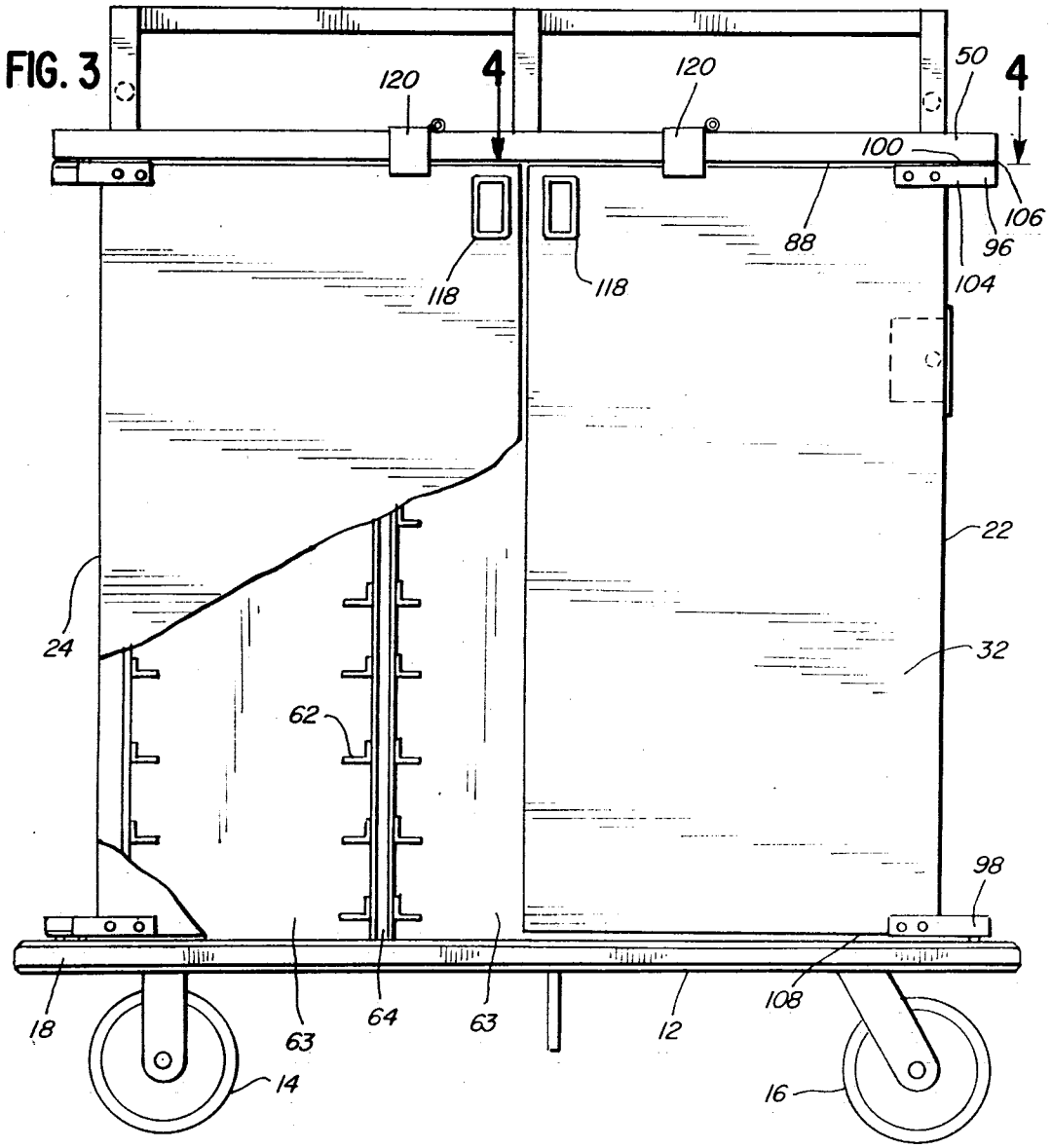
FIG. 3 a side elevation view of the food service cart of FIG. 1 partially broken away to illustrate the tray storage structure.

The invention pertains to the structure for hingedly attaching the doors with the cabinet. According to the invention, one of the doors on each sidewall can be mounted conventionally and the door on the opposite side incorporates a modified hinge. For example, the door 34 in FIGS. 4 and 5 is shown with a conventional hinge at 68 while the opposite door 32 has a modified hinge at 70. Because the arrangement of doors at each end of the cabinet is the same, the discussion relating to the invention will be limited to the combination of doors 32, 34.

The hinge 68 on door 34 comprises upper and lower brackets, 72, 74 respectively. The upper bracket 72 comprises an L-shaped member 75 including an upper, horizontal flange 76 overlying the top edge 78 of the door 34 and an integral depending flange 80 which is bolted conventionally to the front surface 82 of door 34. At least the upper flange 76 extends lengthwise beyond the endwall 22 to define a pivot portion 84. A hinge pin 86 is mounted in the top cabinet plate 50, extends below the bottom surface 88 of the plate 50 and is received pivotally in an aperture 90 on the bracket pivot portion 84.

The lower bracket 74 is mounted with the bottom edge 92 of the door 34 in substantially the same manner as the top bracket. To mount the door 34, the lower bracket is secured to the door and fit on a pivot pin (not shown). The door 34 is pivoted to meet the upper bracket, which is in place over pivot pin 86, and appropriately secured.

The hinge arrangement described in the previous paragraph permits 270° rotation of the door, which range is illustrated in FIGS. 4 and 5. The aperture 90 in the mounting plate is spaced from the plane of the endwall 22 a distance approximately equal to the thickness of the door 34 so that upon rotation clockwise from the FIG. 4 position to that in FIG. 5, the front surface 82 of door 34 facially abuts the flat surface 94 of the endwall 22.

The modified hinge for the door 32 comprises a pair of spaced L-shaped brackets 96, 98. Upper bracket 96 comprises a horizontal flange 100 which overlies the top edge 102 of door 32. An integral depending flange 104 is suitably secured, as by bolting, to the front surface of the door 32. The bracket 96 pivots about a pin 106 depending from the plate 50 in a manner comparable to that of bracket 72 associated with the door 34. The bottom bracket 98 is mounted in a similar fashion about the bottom edge 108 of the door 32.

The bracket 96 has a pivot portion 110 extending beyond the endwall as the portion 84 on the bracket 74. However, the aperture 112 accepting the pivot pin 106 is spaced further from the plane of the endwall 22 than is the aperture 90 on the plate 74. The spacing between the pivot aperture 112 and the plane of endwall 22 is chosen so that with the door 32 closed, the outside surface 114 of door 32 makes close facial engagement with the inside surface 116 on door 34.

As a result, the doors 32, 34, when moved in sequence to their door open position in FIG. 5 reside in parallel planes, overlap closely adjacent each other and the endwall 22 and therefore represent a minimum obstruction beyond the endwall of the cabinet. With this arrangement, the food service carts can be arranged end-to-end without interference between the doors on adjacent carts. At the same time, unobstructed access is provided through either side of the cabinet to the tray retaining area.

A pivot latch 124 is provided on the ends 126 of the plate 50. The latch pivots from its locked position in FIGS. 1 and 2 about a mounting pin 128 off-center of the height of the latch. Pivoting of the latch in either direction allows passage of the doors to their overlapping, open position. In the locked position, the latch 124 overlaps the doors 30, 32 interferingly to prevent pivoting away from the endwalls.

To assist manipulation of the doors, pulls 118 are provided at the upper portion of each door. Further, transport latches 120 provide a redundant locking system for the doors during transportation of the cabinet. These latches 120 augment a conventional locking system that might operate between the inside framework of the cabinet and the inside surface of one or more of the doors.

It should be understood that the foregoing detailed description was made for purposes of clarifying the structure and operation of the invention, with no unnecessary limitations to be derived therefrom.

We claim:

1. In a food service cart having a cabinet with first and second oppositely facing sidewalls and a opening in each said sidewall, a tray storage area within the cabinet, and a flat endwall joining between the first and second sidewalls, improved structure for selectively sealing said opening and allowing unobstructed access to said tray storage area through said openings for inserting or removing trays comprising:

a first door having substantially flat, inside and outside wall surfaces, said inside wall surface extending at least partially across said opening of the first sidewall with the first door in a closed position;

first hinge means pivotally mounting the first door to the cabinet to pivot about a first pivot to an open position in which said outside wall surface of the first door is in parallel juxtaposition with the endwall;

a second door substantially similar to said first door and having substantially flat, inside and outside wall surfaces, each of said first and second doors having distal edges, said inside surface of the second door extending at least partially across said opening of the second sidewall with the second door in a closed position; and second hinge means pivotally mounting the second door to the cabinet to pivot about a second pivot, said second hinge having a length greater than said first hinge by substantially the thickness of said first door, the second door being disposed in an open position in overlapping relationship with the first door with the outside surface of the second door being in substantially parallel juxtaposition with the inside surface of the first door in the open position, said first pivot being spaced from the plane of said endwall approximately one-half the thickness of said first door and said second pivot being spaced from the plane of said endwall approximately the thickness of said first door plus approximately one-half the thickness of said second door, thereby disposing said distal edges of the doors in alignment at said opposite sidewalls when the doors are in the cloed position.

2. The improved hinge structure according to claim 1 wherein said first hinge means comprises at least one bracket associated with one of either the first door and cabinet and a pivot pin on the other of the first door and cabinet and pivotally mating with the bracket, said pivot pin spaced from the plane of the endwall by a first distance to allow pivoting of the first door against the sidewall.

3. The improved hinge structure according to claim 1 wherein said second door is substantially parallel to the endwall in an open position and latch means maintains the second door in said open position to prevent inadvertent pivoting of the second door.

4. The improved hinge structure according to claim 1 wherein said second door has top and bottom edges and said second hinge means comprises a bracket on each of the top and bottom edges of the second door and coaxial, vertically spaced pins on the cabinet and pivotally received in the brackets.

5. The improved hinge structure according to claim 2 wherein said second hinge means comprise at least a second bracket associated with one of either the second door and cabinet and a second pivot pin on the other of the second door and cabinet and pivotally mating with the second bracket, said second pivot pin spaced from the plane of the endwall by a second distance that is greater than said first distance to allow the second door to pivot facially against the first door with the first door in the open position.

6. The improved hinge structure according to claim 2 wherein said cabinet has an upper plate, a bottom platform supports the cabinet and the first hinge means are connected between the plate and the top of the first door and the platform and the bottom of the first door.

* * * * *